United States Patent [19]

Rangaswamy

[11] Patent Number: 4,478,341

[45] Date of Patent: Oct. 23, 1984

[54] TAMPER-RESISTANT CONTAINER

[76] Inventor: Avvari Rangaswamy, 13 Eastern Dr., Littleton, N.C. 27850

[21] Appl. No.: 521,419

[22] Filed: Aug. 8, 1983

[51] Int. Cl.[3] ..... B65D 8/06

[52] U.S. Cl. ..... 215/12 R; 220/257; 220/258; 220/429

[58] Field of Search ..... 215/12 R; 220/257, 258, 220/345, 429; 229/4.5

[56] References Cited

U.S. PATENT DOCUMENTS

| | | | |
|---|---|---|---|
| 3,101,839 | 8/1963 | Holman | 220/429 |
| 3,214,074 | 9/1963 | Schechter . | |
| 3,255,928 | 5/1963 | Foster . | |
| 3,621,989 | 3/1970 | Pregont . | |
| 3,662,915 | 10/1970 | Destler . | |
| 3,935,960 | 1/1975 | Cornell . | |
| 4,133,447 | 11/1977 | Bouchet . | |
| 4,165,018 | 8/1978 | Giggard . | |
| 4,240,560 | 12/1980 | Carluccio | 215/12 R |

*Primary Examiner*—George T. Hall
*Attorney, Agent, or Firm*—Irons & Sears

[57] ABSTRACT

A tamper-resistant double walled container with an access system requiring the removal of a portion of the outer wall, the removal of tamper indicating material, such as cotton, the opening of a shutter, and the removal of a portion of the inner wall.

5 Claims, 2 Drawing Figures

TAMPER-RESISTANT CONTAINER

BACKGROUND OF THE INVENTION

This invention relates to a system for providing access to the contents stored in a container, and for sealing the container such that if the sealing system is tampered with physically visible changes in the sealing system will record the tampering.

Manufacturers are continually seeking more tamper resistant containers in which to ship and sell products intended for human consumption. Such products include over-the-counter medications and foods, e.g., candies, spices, etc. In recent years containers used for many of these articles have the port through which access to the contained product is to be made sealed at the time of filling the container and the seal is not to be broken until the buyer of the product makes the first use. Examples of such systems include: snap-on-caps taped to the container so that the tape has to be cut in order to remove the cap; screw-on-caps which are affixed to retaining collars by perforated metal rings that break in two so that the cap separates from the retaining collar when the screw-on-cap is first removed from the container; tape or plastic film adhesively mounted over the mouth of the opening to a container which have to be torn away in order to remove products from the container. Also used for packaging products which are not supposed to be tampered with are so-called blister pacs, in which, for example, individual pills of medication can be stored in separate compartments that are emptied by rupturing a wall of the blister container.

Excessive difficulty in accessing the packaged contents is not always the primary purpose of these sealing systems. Instead these sealing systems are in part intended to assure that the packages are not inadvertently opened, or accidentally opened by, for example, children, and that if opened such opening is in some way permanently recorded. To achieve these dual purposes containers have been fitted with rupturable parts which must be broken prior to opening the package. See, for example, U.S. Pat. No. 4,165,018 to Giggard, U.S. Pat. No. 3,662,915 to Destler, and U.S. Pat. No. 3,255,928 to Foster.

SUMMARY OF THE INVENTION

The present invention provides a container with a versatile access system configured to prevent tampering with the product packaged in the container during shipping and storage prior to purchase by a consumer. Further, this access system is configured so as to provide notice to users or purchasers of the container as to whether the contents have been accessed after the container was initially filled and sealed.

While achieving these purposes, the access system still provides a system which users can operate for ready access to the contents packaged within the container. The access system of the present invention also allows for the waterproof packaging of goods such as perishable foods, e.g., candy, nuts, coffee powder, sugar, flour, spices and the like.

Further, the present invention provides a container with an access system so configured as to allow for the storage and dispensing of "high-risk" products. Examples of "high-risk" items include among others medicaments, fragile electronic parts, any substance easily deteriorated or destroyed by hydration, and any product in which sterility of the product is essential such as blood, culture medium(s), serum and other biological fluids.

In accordance with these objectives, the present invention comprises a double walled container having means for indicating whether or not the contents of the container were accessed subsequent to the filling of the container. For a preferred embodiment of the present invention, the double walled container is fabricated of a pliable plastic. Within the outermost wall of the container, part of which must be stripped away to provide access to the container, is a layer of tamper-indicating material. Suitable tamper-indicating materials for the present invention can include cotton, thermoplastic resilient materials such as foam, shredded Dupont mylar or the like, shredded foam rubber or other compliant material which generally maintains the shape to which it is last compressed. Therefore, any synthetic or natural material which retains its shape, for example, about an area of the wall surface of the container, to provide an open access port into the container, after being moved or removed from the area of the access port, provides an adequate tampering-indicating material. Once the tampering-indicating material is moved away or removed from the access port area, a shutter between the inner and outer walls of the container must be slid away. Behind the shutter can be a second layer of the tampering-indicating material. When this second tamper-indicating layer is moved away or removed, the inner wall of the container is exposed. That portion of the inner wall, in the area of the access port, must also be removed before the contents of the container can be accessed. For convenience the sections of the outer and inner walls which must be removed are bordered with depressions or grooves which structurally weaken the wall so as to allow easy removal of the encircled wall sections.

BRIEF DESCRIPTION OF THE DRAWINGS

The various objects, advantages and novel features of the present invention will be more readily apprehended from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
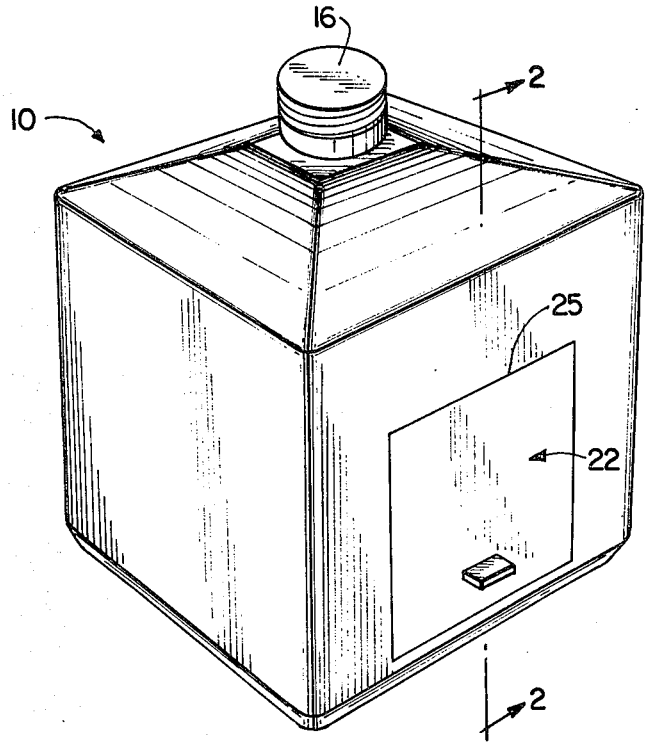
FIG. 1 is a perspective view of a container incorporating an access system of the present invention.

A container according to the invention is illustrated in FIG. 1 and generally designated by reference numeral 10. Container 10 includes outer wall 12 and inner wall 14. It is to be understood that the outer wall 12 and the inner wall 14 of container 10 may be fabricated using any durable material such as plastic, metal or cardboard. For purposes of the following description plastic is the selected material.

The cap 16 at the top of container 10 is permanently sealed by known and suitable means such as gluing, fusing, brazing, etc. after container 10 has been filled with contents 18. This permanent sealing of cap 16 precludes later access to contents 18 through port 20.

Access to the contents 18, in container 10, through the access system of the present invention, which is generally designated by reference numeral 22, is achieved through the following series of steps. First, the outer access wall section 24 of outer wall 12 is removed. The plastic outer wall 12 is scored around the boundary of outer access wall section 24 to facilitate this removal. Therefore, by using tab 23 to pull outer access wall section 24 away from container 10 the outer wall 12 is torn along the score 25.

Figure 2:
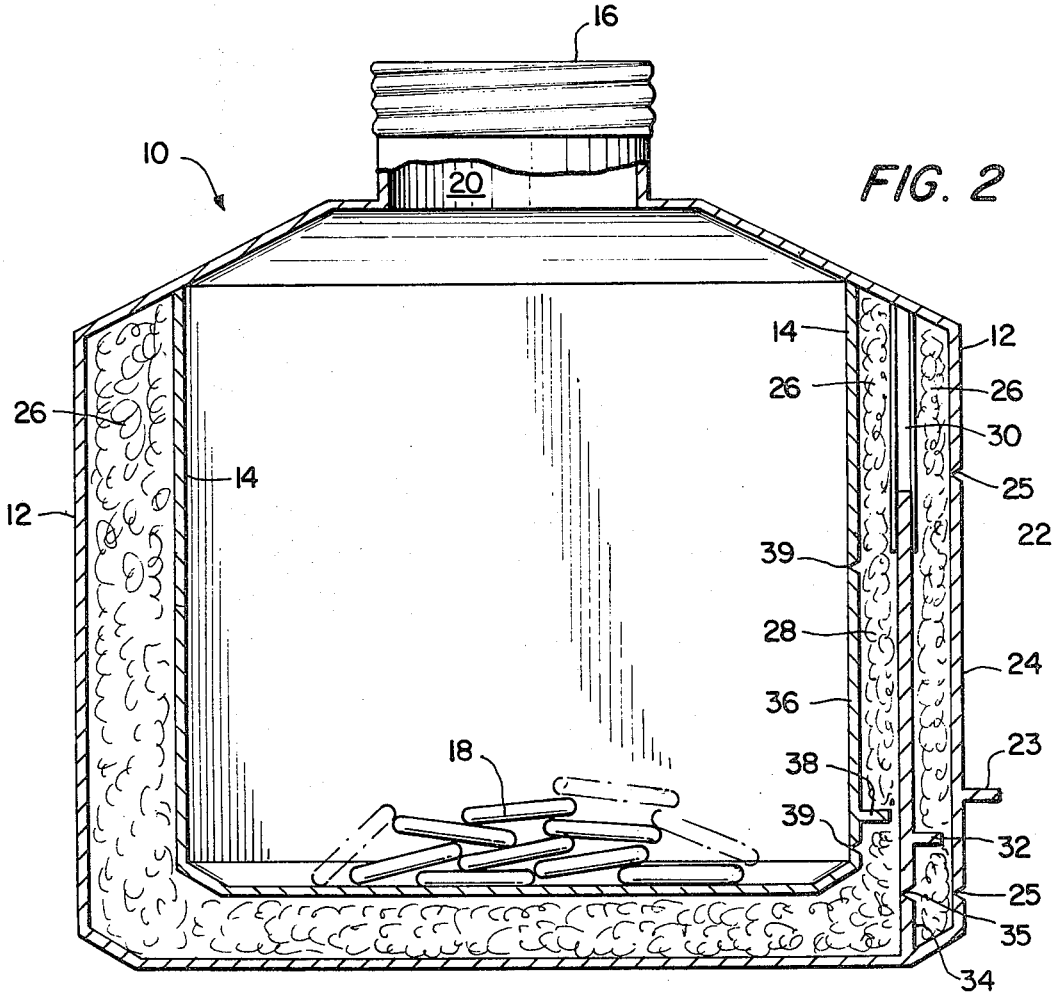
FIG. 2 is a cross section of the container illustrated in FIG. 1 showing the configuration of the elements of the access system of the present invention prior to the opening of the container.

When outer access wall section 24 is removed, a first layer of tamper-indicating material 26 is exposed. Tamper-indicating material 26, as shown in FIG. 2, substantially fills the volume of space between outer wall 12 and inner wall 14. Cotton, thermoplastic resilient materials such as foam, shredded Dupont mylar, shredded foam rubber or other compliant materials are suitable for tamper-indicating material 26. Tamper-indicating material 26 must generally be both compliant and also generally maintain the shape to which it is last formed. With outer access wall section 24 removed, the underlying tamper-indicating material 26 is moved away from the area of outer access wall section 24 or removed. Prior to the movement or removal of this layer of tamper-indicating material 26, the tamper-indicating material 26 should be examined for indications of prior tampering such as crimping, pilling, fraying, or in general, distortion of a smooth surface.

Such removal of the first layer of tamper-indicating material 26 exposes shutter 28. Shutter 28 is mounted in grooved track 30. So by using tab 32 shutter 28 can be moved up and down in grooved track 30. Shutter 28 may be retained, prior to the first opening, by attachment to plastic stub 34. The attachment of shutter 28 to stub 34 will be severed on the first opening of shutter 28 by a tearing along groove 35.

When shutter 28 is slid up from its initial position, where it was retained by attachment to stub 34, a second layer of tamper-indicating material 26 is exposed. When the second layer of tamper-indicating material 26 is moved or removed, the inner wall 14 of container 10 is exposed. Similar to outer wall 12, inner wall 14, in this general location, includes an inner access wall section 36 with tab 38. Inner access wall section 36 is removed by pulling on tab 38 so that the plastic inner wall 14 is torn along the scoring 39 that borders inner access wall section 36. With the removal of inner access wall section 36 access to the contents 18 of container 10 is achieved.

After initial access to contents 18 shutter 28 can be returned to the down position until the next access to container 10 is to be made.

Contents 18 can include not only those general substances identified above, but also can include further containers for electronic components, prepackaged medicaments, etc.

The above discussion and related illustrations of the present invention are directed primarily to preferred embodiments and practices of the invention. However, it is believed that numerous changes and modification in the actual implementation of the concepts described herein will be apparent to those skilled in the art, and it is contemplated that such changes and modifications may be made without departing from the scope of the invention as defined by the following claims.

What is claimed is:

1. An access system for a tamper-proof package comprising:

a double walled container, with both the inner and outer walls of said double walled container being continuous subsequent to the filling of said container;

a port for filling said container, which port is permanently sealed subsequent to the filling;

a layer of compliant tamper-indicating material filling the volume between said inner and outer walls, an outer access wall section located on said outer wall, the area of said outer access wall section being defined by means permitting reduced resistance to removal of said outer access wall section from said outer wall;

a shutter mounted in a grooved track between said outer wall and said inner wall, said shutter further being located between said outer access wall section and said inner wall with a layer of said compliant tamper-indicating material between said shutter and said outer access wall section and a layer of said compliant tamper-indicating material between said shutter and said inner wall, said shutter being moveable in said groove track so as to be removed from the area between said outer access wall section and said inner wall;

an inner access wall section located on said inner wall, the area of said inner access wall section being defined by means permitting reduced resistance to removal of said inner access wall section from said inner wall.

2. An access system as set forth in claim 1 in which said inner wall and said outer wall are composed of plastic.

3. An access system as set forth in claim 1 in which said inner wall and said outer wall are composed of metal.

4. An access system as set forth in claim 1 in which the means permitting reduced resistance to removal of said outer access wall section and said inner access wall section consists of a scoring of said outer wall and said inner wall about the areas of said outer access wall section and said inner access wall section to facilitate tearing of said outer wall and said inner wall.

5. An access system as set forth in claim 1 in which said shutter is retained in its initial down position prior to opening by attachment to a stub affixed to said outer wall; and, release of said shutter for movement to the up position is accomplished by tearing along a scored or weakened portion of the attachment of said shutter to said stub.

* * * * *